US006115971A

United States Patent [19]

Loebertmann et al.

[11] Patent Number: 6,115,971

[45] Date of Patent: Sep. 12, 2000

[54] PORTABLE RESTROOM

[75] Inventors: Douglas E. Loebertmann, Shakopee; Michael Holm, Brooklyn Park, both of Minn.

[73] Assignee: Satelite Industries, Inc., Plymouth, Minn.

[21] Appl. No.: 08/909,466

[22] Filed: Aug. 12, 1997

Related U.S. Application Data

[63] Continuation of application No. 08/808,715, Feb. 28, 1997, abandoned, which is a continuation of application No. 08/674,284, Jul. 1, 1996, abandoned, and a continuation of application No. 08/351,710, Dec. 8, 1994, abandoned, which is a continuation-in-part of application No. 29/020,859, Apr. 4, 1994, Pat. No. Des. 372,537.

[51] Int. Cl.[7] ..... A47K 4/00

[52] U.S. Cl. ..... 52/79.1; 52/34; 49/486; 4/449; 4/460

[58] Field of Search ..... 52/39, 79.1; 4/449, 4/451

[56] References Cited

U.S. PATENT DOCUMENTS

| | | | |
|---|---|---|---|
| 2,220,482 | 11/1940 | Fuller | 52/34 |
| 3,447,167 | 6/1969 | Harding | 52/34 X |
| 3,835,480 | 9/1974 | Harding | 4/449 X |
| 4,233,692 | 11/1980 | Sinsley | 52/34 X |
| 4,305,164 | 12/1981 | Sargent et al. | 52/34 X |
| 4,380,836 | 4/1983 | Braxton | 4/449 X |
| 4,993,201 | 2/1991 | Bunyard | 52/34 X |
| 5,379,466 | 1/1995 | Davies | 4/449 |
| 5,398,465 | 3/1995 | Tagg | 52/34 X |

FOREIGN PATENT DOCUMENTS

| | | | |
|---|---|---|---|
| 2271581 | 4/1994 | United Kingdom | 4/449 |

*Primary Examiner*—Beth A. Stephan
*Attorney, Agent, or Firm*—Craig J. Lervick; Daniel G. Chapik; Oppenheimer Wolff & Donnelly LLP

[57] ABSTRACT

The present invention includes an enclosure with a floor that include an upper side and a lower side opposing the upper side. The lower side contacts a surface and is reversibly attachable to the surface. The enclosure also includes a sidewall attached to the floor.

75 Claims, 4 Drawing Sheets

PORTABLE RESTROOM

This is a continuation of prior application Ser. No. 08/808,715, filed Feb. 28, 1997, now abandoned which is a continuation of prior application Ser. No. 08/674,284, filed Jul. 1, 1996, now abandoned, and a continuation of prior application Ser. No. 08/351,710, filed Dec. 8, 1994, now abandoned, which is a Continuation-In-Part of copending U.S. application Ser. No. 29/020,859, filed Apr. 4, 1994.

BACKGROUND OF THE INVENTION

The present invention relates to a portable restroom for use by disabled individuals.

Providing portable restroom access to an individual having limited mobility has been a difficult task. This is particularly true in providing portable restroom access to an individual confined to a wheelchair. By "portable restroom" is meant a portable enclosure that contains a toilet and that may contain other features such as a handwash.

Portable restrooms conventionally include a frame and runners attached to the frame. A floor is also attached to the frame and opposes the runners. The frame also defines a cradle, adjacent to the floor, for holding a waste tank in place. The runners are typically wooden boards that support the frame. Typically, the runners have a height of at least about 3–4 inches and the frame has a height of about 3–4 inches, thereby elevating the floor about 7 inches from a ground surface.

The runners enable a portable restroom to be moved with a device such as a forklift. In particular, prongs of the forklift may be positioned between the runners. The runners also aid in moving the portable restroom for transport.

Unfortunately, the presence of the runners makes use of the portable restroom by an individual of limited mobility exceedingly difficult, if not impossible. The individual is unable to step from the ground surface to the floor of the restroom because of the height of the runners and frame and consequent elevation of the floor. Unless a ramp is provided, an individual in a wheelchair cannot access the portable restroom at all.

Some portable restrooms for use by disabled individuals are fitted with ramps in order to provide access to an individual in a wheelchair. However, the ramps have tended to be too steep or too long to provide easy access to the restroom. Additionally, attachment of the ramps to the conventional restrooms has been problematic. Because the restrooms are portable, the ramp attachment for each restroom is typically temporary. The ramp is typically attached and detached multiple times. As a consequence, the attachment may fail. If the ramp attachment fails, use of the ramp becomes dangerous for a disabled user.

Further, the use of a ramp in conjunction with a portable restroom has required individuals transporting portable restrooms to transport additional ramp and attachment components. Individuals preparing portable restrooms for use at a site must expend additional time and skill installing the ramps on the restrooms. The additional ramp and attachment components have then, been both inconvenient and inefficient.

One additional problem with providing an adequate portable restroom for the disabled individual concerns manufacture of the restroom. A conventional portable restroom has dimensions that are not suitable for use by an individual in a wheelchair. This is because the restroom must be of a size that permits the user to turn a complete circle while in a wheelchair. Conventional restrooms do not provide enough space to turn the complete circle. Further, conventional portable restrooms do not comply with federal regulations specifying restroom dimensions for the disabled.

Consequently, portable restrooms made for use by disabled individuals have typically been separately manufactured using different tools and processes. In particular, separate, large molds have been used to fabricate components for constructing a restroom that provides access to individuals in wheelchairs. Because the overall number of portable restrooms used by disabled individuals is relatively small, it has not been efficient for a restroom manufacturer to separately design and produce a different restroom for use by disabled individuals.

One additional factor that manufacturers must consider includes a body of regulations directed to specifying restroom features for accessibility. Compliance with these regulations has required restroom designs and manufacturing requirements very different from what has been used for conventional restrooms.

SUMMARY OF THE INVENTION

The portable enclosure of the present invention includes a floor having an upper side and a lower side opposing the upper side. The lower side of the floor contacts a surface that is reversibly attachable to the enclosure. The enclosure also includes a sidewall attached to the floor.

The present invention further includes a method for making a portable enclosure. The method includes providing a floor section, providing four substantially identical sidewalls, cutting one of the four sidewalls to make a door and a wall with an opening, attaching the four sidewalls to the floor and attaching the door to the sidewall to reversibly close the opening.

DETAILED DESCRIPTION OF PREFERRED EMBODIMENTS

Figure 1:
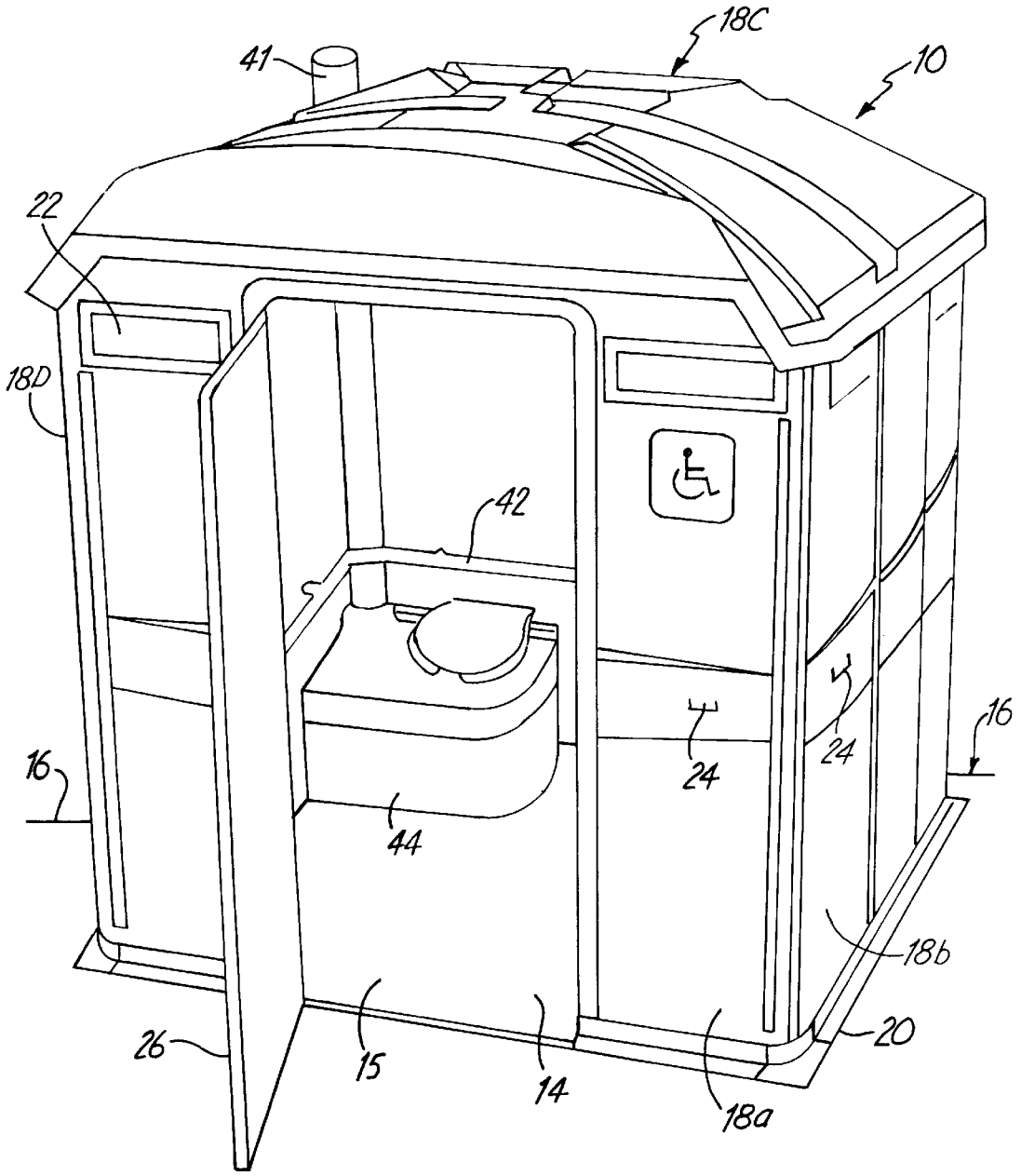
FIG. 1 is a perspective view of a portable restroom embodiment of the enclosure of the present invention.

The portable restroom of the present invention illustrated generally at 10 in FIG. 1, includes a floor 14 in contact with a surface 16 reversibly attachable to the restroom 10 and a plurality of sidewalls 18*a–d,* made from a single mold, attached to the floor 14.

The surface 16 may be earth, cement, asphalt, grass or any other surface reversibly attachable to the restroom 10 upon which the restroom 10 rests. By "reversibly attachable" is meant that the floor 14 may rest, unattached, on the surface 16. The floor 14 may also be attached to the surface 16 by bolts, ties or other restraints that may be removed when it is desired to move the portable restroom.

The feature of the floor 14 in contact with the reversibly attachable surface 16 permits a disabled individual, particularly an individual in a wheelchair, to use the portable restroom 10 without a need for a ramp. The ease of use and safety for the disabled user is then increased. Further, suppliers of restrooms no longer have to provide ramps and ramp attachments in conjunction with a portable restroom for use by a disabled individual.

Figure 5:
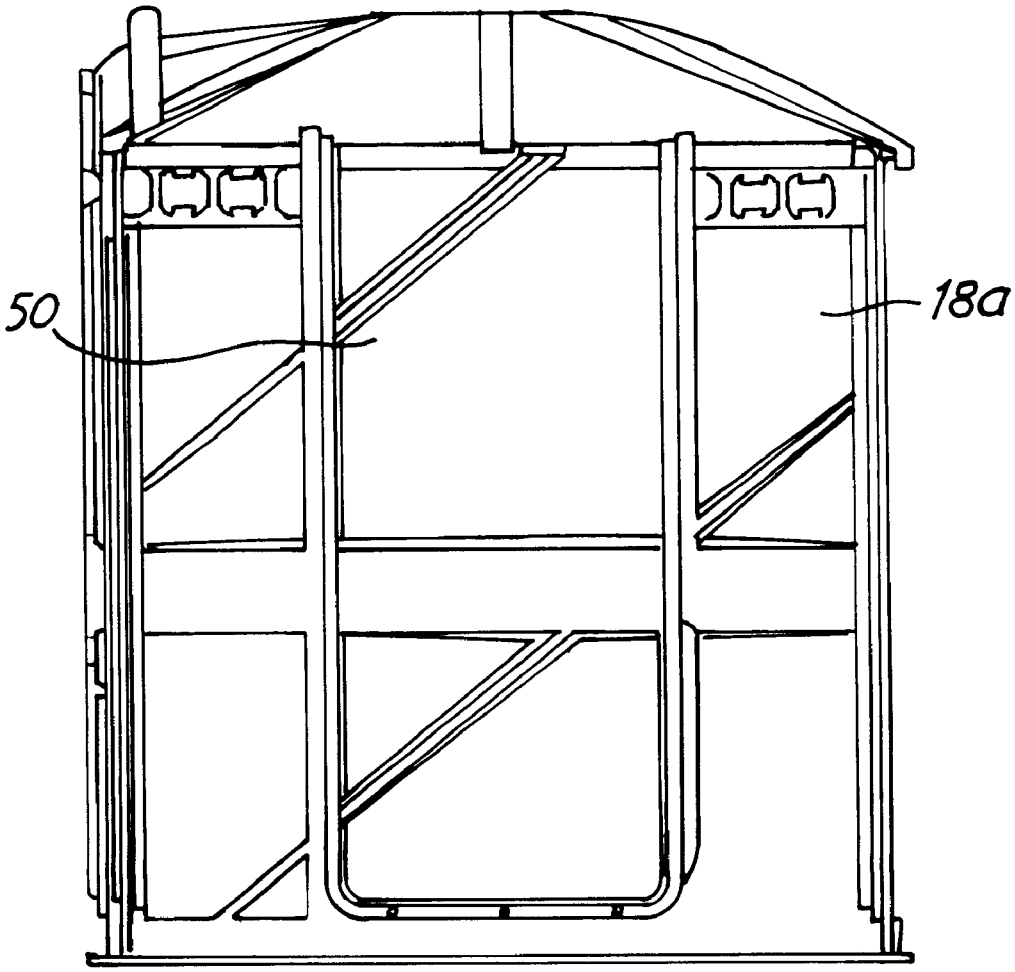
FIG. 5 is a view of an installed sidewall of the portable restroom of the present invention without the door.

Additionally, the sidewalls 18*a, b, c* and *d* permit the portable restroom of the present invention 10 to be efficiently constructed. Preferably, each of the sidewalls is made with a single mold imparting a door pattern such as is illustrated at 50 in FIG. 5. The door pattern includes an outline for sizing and positioning a door. The molded door pattern 50 further improves efficiency of manufacture of the restroom by standardizing door size and positioning. In another embodiment, sidewalls are made by separate, substantially identical molds. The identical molds include the door pattern 50.

As a consequence of the standard sidewall size and molded features, a restroom manufacturer need only manufacture a single type of sidewall 18*a–d* in order to make the restroom of the present invention. The sidewalls 18*a, b, c* and *d* are of a large size that permits a manufacturer to make a portable restroom for use by disabled individuals in compliance with federal law. In particular, the single design of sidewalls 18*a–d* efficiently makes a portable restroom that permits a disabled user in a wheelchair to turn a complete circle in the restroom 10. Thus, the single type of sidewall 18 of the present invention promotes an efficiency of manufacture not heretofore available.

The sidewalls 18*a–d* are made of a molded polymeric material. Preferably, the sidewalls are made of polyethylene. While 4 sidewalls 18*a–d* are described, it is understood that the portable restroom 10 of the present invention may include more than 4 sidewalls.

The floor 14 of the portable restroom has a preferred thickness that is not more than about ½ inches. The floor may acceptably have a thickness within a range of about ½ to ¾ inches. The floor 14 includes an upper surface 15 and a lower surface 20. In one preferred embodiment, the lower surface 20 has a reduced coefficient of friction as compared to a material such as wood.

Preferably, the floor 14 is made of polyethylene. The polyethylene is lightweight, nonporous and relatively easy to keep clean. It is contemplated, however, that other materials with a similar coefficient of friction would be suitable as the lower floor surface 20.

The floor 14 may be made entirely of polyethylene. Alternately, the floor may be made of a construction material such as wood and coated with a material such as polyethylene. The floor may also be made entirely of a material such as wood.

The portable restroom 10 can be readily moved with a forklift. Prongs of the forklift slip under the floor 14, and move the portable restroom 10. The lower floor surface embodiment 20 of the portable restroom 10 facilitates the positioning of forklift prongs under the floor 14.

The upper surface 15 of the floor 14 has an antiskid consistency of sufficient roughness to reduce the possibility of an individual slipping on the surface 15. The roughness may be imparted by roughening a smooth surface or by employing a rough or gripping material as the surface material.

The floor 14 of the portable restroom of the present invention is distinguishable over floors of conventional restrooms because the floor 14 is not attached to a frame with runners such as is the case for a conventional restroom floor. The runners and frame elevate the portable restroom about 7 inches from a ground surface. Because of this substantial elevation, a disabled user cannot access the conventional restroom without a device such as a ramp.

Like conventional portable restrooms, the restroom 10 of the present invention includes a toilet 44, a vent pipe 41, a tank 54 and other articles typically found in a portable restroom. While the toilet 44 is shown in a particular corner in FIG. 1, it is understood that the toilet 44 may be positioned in other locations within the restroom 10.

In the portable restroom 10 of the present invention, there is only about ½ inch from the upper surface 15 of the floor 14 to the ground surface 16. A disabled individual such as an individual confined to a wheelchair can readily overcome this small elevation in order to use the portable restroom 10.

The floor 14 of the portable restroom 10 of the present invention preferably has a weight that is about ⅓ of the total weight of the restroom 10. This weight distribution aids in weighting the restroom 10 so that the restroom 10 has an improved stability in environments such as those with high wind conditions.

Because the sidewalls 18*a, b, c* and *d* of the portable restroom 10 are substantially identical, each of the sidewalls 18*a–d* includes features such as a vent 22. Additionally, in one embodiment, each sidewall 18*a–d* may include a handle 24. The handle 24 aids in moving the portable restroom 10.

Figure 3:
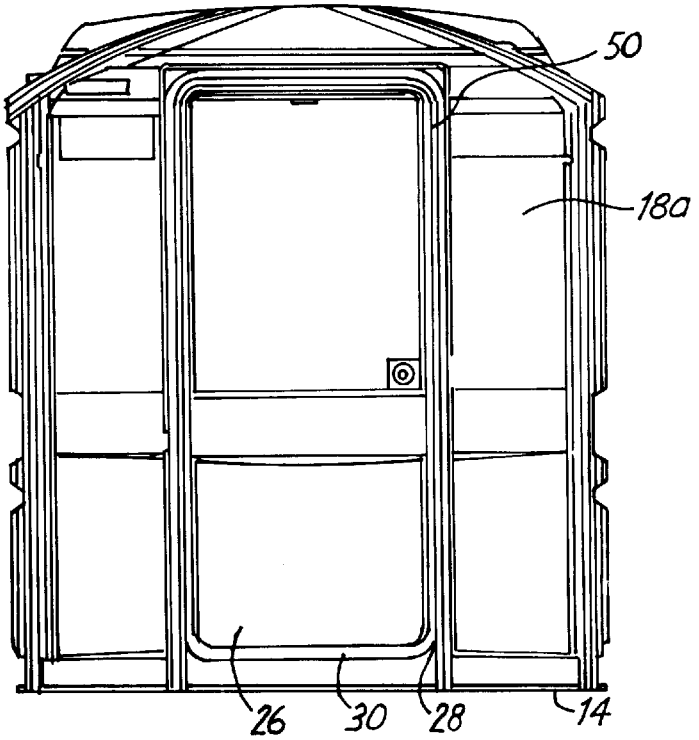
FIG. 3 is a view of an installed sidewall of the portable restroom of the present invention with a door installed.

One of the sidewalls of 18*a–d* is selected for making and positioning a door 26. Each of the sidewalls 18*a–d* includes the door molded configuration 50, illustrated in FIG. 3, that may be fitted with a door frame 52. The door frame 52 may be a metal strip. The door 26 is made by cutting a segment 28 out of one of the sidewalls 18*a–d* and trimming the segment 28 to provide a clearance 30 between the door 26 and the floor 14. The clearance 30 should permit closure of the door 26 in the presence of obstacles such as grass or stones on the ground surface 16. In one embodiment, a skirt (not shown), such as a bristled skirt, is attached to the door 26. The skirt extends from the door to the floor.

Figure 4:
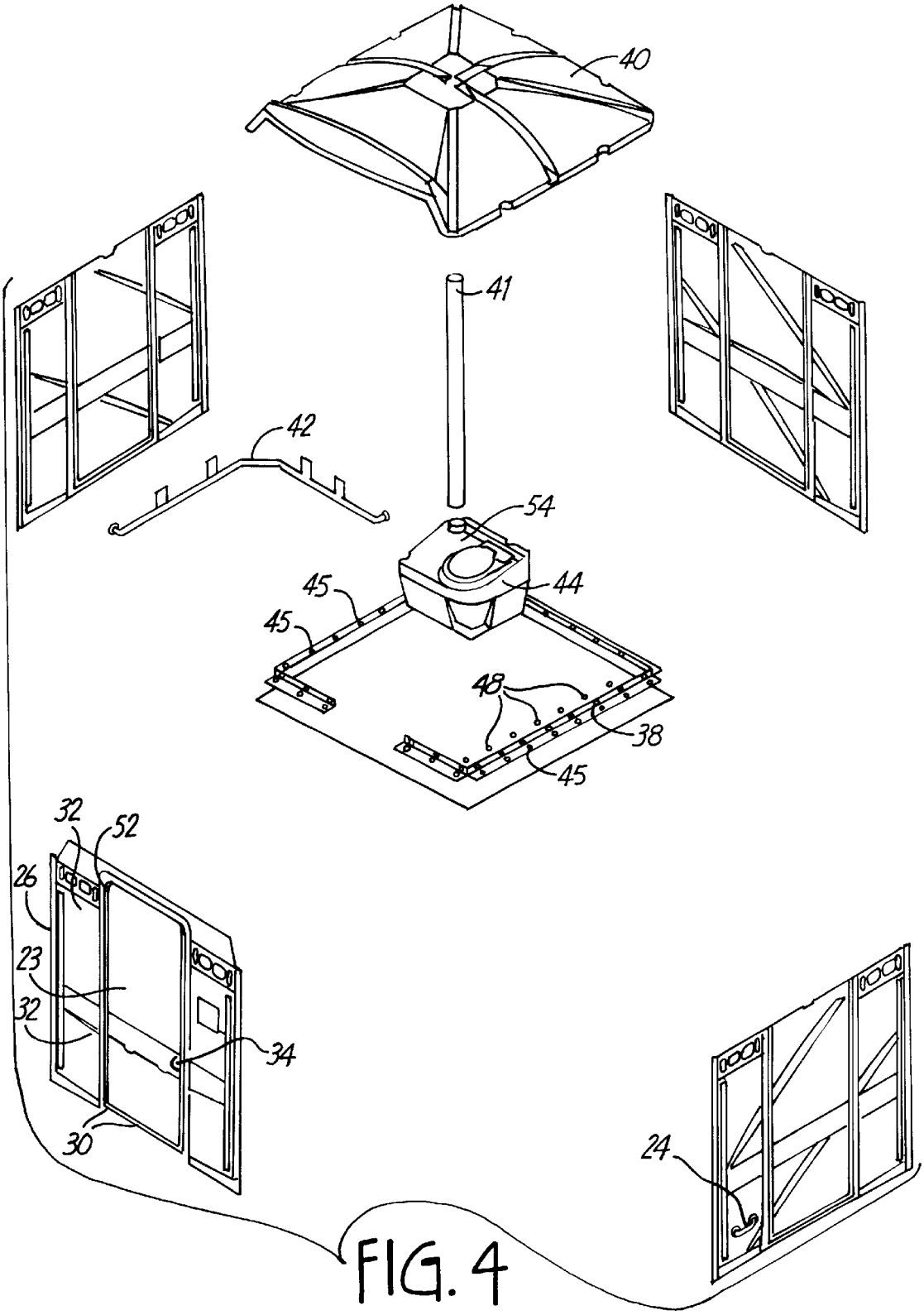
FIG. 4 is an exploded view of the portable restroom of the present invention.

The door 26 is attached to the sidewall 18*a* by the door frame and a plurality of hinges 32 such as are illustrated in FIG. 4. The door 26 includes a handle 34 and a latch (not shown) for opening and closing the door 26. The handle 34 and latch preferably comply with locking regulations specified in 28 C.F.R. Part 36, as issued Jul. 26, 1991.

The sidewalls 18*a–d* may be attached to the floor 14 by any conventional attachment. In one embodiment illustrated in FIG. 4, the attachment is made by an angle 38. Each of the angles 38 and the sidewall 18*a–d* includes holes 45. The holes 45 are aligned and a fastener such as a rivet 48 is inserted into the hole 45. The rivet 48 is secured by any conventional device.

Figure 2:
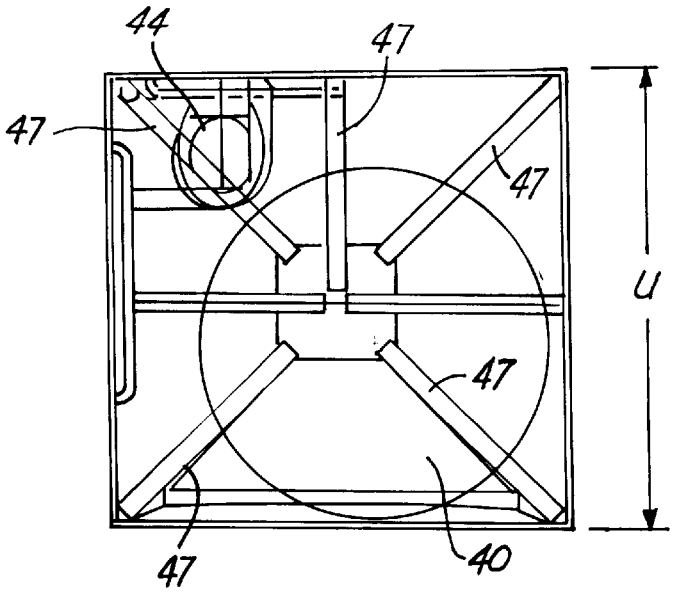
FIG. 2 is a top view of the portable restroom of the present invention.

A roof 40 is attached to each of the four sidewalls 18*a–d*. The roof 40 is preferably made of one piece and imparts strength and dimensional stability to the restroom 10. In one embodiment shown in FIG. 2, the roof 40 includes channels 47 for directing rain off of the roof 40. The roof 40 is fabricated so that a vent pipe 41 is positionable in a rear corner of the portable restroom 10. The roof 40 is fastened to each of the sidewalls 18*a–d* by a conventional fastener such as a bolt.

It has surprisingly been found that when the vent pipe 41 is positioned in a rear corner of the restroom 10, the vent pipe 41, and tank 54 may be secured to the sidewall 18 by a single screw (not shown). The screw is inserted into the sidewall from an outside surface of the sidewall 18 and extends into the vent pipe 41 and tank 54.

A hand rail 42 is installed on one or more of the sidewalls 18*a–d*. The hand rail 42 is positioned in a manner that aids a handicapped user's mobility within the portable restroom 10. The user may grip the handrail in order to move about in the restroom 10. In one embodiment, the handrail 42 is zinc plated to provide a resistance to corrosion. The handrail 42 is preferably made of any material having corrosion resistance and having strength to support weight of the user. The handrail 42 is preferably of a single piece that is attached to two or more of the sidewalls 18*a–d* as shown in FIG. 4.

The handrail 42 serves an additional structural function as well. The handrail 42 stiffens each sidewall 18*a–d* to which it is attached. Preferably, the hand rail 42 continuously extends to at least two to three sidewalls 18*a–d* as shown in FIG. 1. It is also contemplated that the handrail 42 may be attached to all sidewalls 18*a–d* and extend about a perimeter of the restroom 10. With these embodiments, the hand rail 42 stiffens the entire portable restroom enclosure 10. The handrail 42 prevents the portable restroom 10 from collapsing and losing shape due to uneven exposure to stress such as from handling, and wind, once placed in service.

It is contemplated that the process of the present invention may be used to make enclosures other than portable restrooms for disabled individuals. It is believed that the use of substantially identical sidewalls and a floor reversibly attachable to a ground surface may be used to construct storage enclosures, fish houses, bus stop enclosures and other types of portable enclosures.

Although the present invention has been described with reference to preferred embodiments, workers skilled in the art will recognize that changes may be made in form and detail without departing from the spirit and scope of the invention.

What is claimed is:

1. A portable restroom enclosure comprising:

a floor sized to permit movement of a wheelchair that includes an upper side having a coefficient of friction effective to impede movement of the wheelchair and a lower side, opposing the upper side, the lower side contacting a surface that is reversibly attachable to the enclosure wherein the floor has a weight effective to stabilize the restroom when exposed to a wind; the upper side being positionable at a distance no greater than about one inch from a ground surface; at least three substantially identical side walls attached to the floor and a toilet that includes a holding tank and a vent pipe attached to the holding tank wherein the toilet is attached to floor and further wherein each of the holding tank, vent pipe, and piping and plumbing fixtures in communication with the toilet, holding tank and vent pipe are at an elevation no lower than a base of the toilet.

2. The enclosure of claim 1 wherein the enclosure is portable.

3. The enclosure of claim 1 wherein the floor has a lower surface that has a low coefficient of friction.

4. The enclosure of claim 1 wherein the floor has an upper surface that is antiskid.

5. The enclosure of claim 1 wherein the floor has a thickness effective for strengthening the enclosure.

6. The enclosure of claim 1 wherein the floor has a thickness within a range of about ½ inches to ¾ inches.

7. The enclosure of claim 1 and further including a rail positioned on the sidewall thereby stiffening the enclosure.

8. The enclosure of claim 1 and further including a second sidewall opposing the first sidewall, the second sidewall having a configuration substantially identical to the first sidewall.

9. A method for making a portable restroom enclosure for use by an individual confined to a wheelchair comprising:

providing a floor section wherein the floor includes an upper side and a lower side having a coefficient of friction effective to impede movement of the wheelchair wherein the floor is effective to stabilize the restroom when exposed to a wind;

providing a plurality of substantially identical side walls, made from a single mold;

cutting one of the side walls to make an opening and a door;

attaching the side walls to the floor; and contacting the floor section to the ground.

10. The method of claim 9 wherein the enclosure has use as a portable restroom.

11. The method of claim 9 wherein the floor has a thickness within a range of about ½ to ¾ inches.

12. The method of claim 9 and further including providing a vent pipe and a tank; positioning the vent pipe and tank on the floor section and securing the vent pipe and tank to one of the sidewalls with a single attachment mechanism.

13. The method of claim 12 wherein the attachment mechanism is a screw.

14. The portable restroom of claim 1 wherein the lower side of the floor has a coefficient of friction less than the upper side.

15. A portable restroom enclosure permitting wheelchair access comprising:

a floor sized to permit movement of a wheelchair, wherein the floor is positionable so as to be in contact with an underlying supporting surface;

a toilet system located on and positioned above an upper surface of the floor within the enclosure;

at least three substantially identical side walls attachable to the floor; and a doorway permitting wheelchair access from the underlying support surface through one of the at least three substantially identical sidewalls and into the portable restroom enclosure from the underlying support surface.

16. The portable restroom enclosure of claim 15 wherein the floor has a weight that is equal to about ⅓ of a total weight of the portable restroom enclosure.

17. The portable restroom enclosure of claim 15 wherein the floor has a weight that is greater than ⅓ of a total weight of the portable restroom enclosure.

18. The portable restroom enclosure of claim 15 wherein a total distance from the underlying supporting surface to the upper surface of the floor is equal to a thickness of the floor.

19. The portable restroom enclosure of claim 18 wherein the thickness of the floor is less than about 1".

20. The portable restroom enclosure of claim 15 wherein the toilet system includes a holding tank and a ventilation pipe.

21. The portable restroom enclosure of claim 15 wherein the floor has a weight effective to stabilize the restroom when exposed to a wind.

22. The portable restroom enclosure of claim 15 wherein the floor has a lower surface that has a low coefficient of friction.

23. The portable restroom enclosure of claim 15 wherein the upper surface of the floor is an anti-skid surface.

24. The portable restroom enclosure of claim 15 further including a rail positioned on at least two of the at least three sidewalls thereby stiffening the enclosure.

25. The portable restroom enclosure of claim 15 wherein the upper surface of the floor is an anti-skid surface.

26. The portable restroom enclosure of claim 15 further including a rail positioned on at least two of the at least three sidewalls thereby stiffening the enclosure.

27. A portable restroom enclosure permitting wheelchair access comprising:

a floor sized to permit movement of a wheelchair, the floor having an upper surface and a lower surface wherein the upper surface of the floor is positionable within a predetermined distance of an underlying support surface, wherein the predetermined distance is within a range permitting rolling movement of a wheelchair from the underlying support surface to the upper surface;

a toilet system located on and positioned above the upper surface of the floor within the enclosure;

at least three substantially identical side walls attachable to the floor; and a doorway permitting wheelchair access from the underlying support surface through one of the at least three substantially identical sidewalls and into the portable restroom enclosure.

28. The portable restroom enclosure of claim 27 wherein the predetermined distance is less than or equal to about one inch.

29. The portable restroom enclosure of claim 27 wherein the floor has a weight that is equal to about ⅓ of a total weight of the portable restroom enclosure.

30. The portable restroom enclosure of claim 27 wherein the floor has a weight that is at least ⅓ of a total weight of the portable restroom enclosure.

31. The portable restroom enclosure of claim 27 wherein a total distance from the underlying supporting surface to the upper surface of the floor is equal to a thickness of the floor.

32. The portable restroom enclosure of claim 31 wherein the thickness of the floor is less than about 1".

33. The portable restroom enclosure of claim 27 wherein the toilet system includes a holding tank and a ventilation pipe.

34. The portable restroom enclosure of claim 27 wherein the floor has a weight effective to stabilize the restroom when exposed to a wind.

35. The portable restroom enclosure of claim 27 wherein the lower surface has a low coefficient of friction.

36. The portable restroom enclosure of claim 27 wherein the upper surface of the floor is an anti-skid surface.

37. The portable restroom enclosure of claim 27 further including a rail positioned on at least two of the at least three sidewalls thereby stiffening the enclosure.

38. A portable restroom enclosure permitting wheelchair access comprising:

a floor sized to permit movement of a wheelchair, wherein the floor is positionable so as to be in contact with an underlying supporting surface;

a toilet system located on and positioned above an upper surface of the floor within the enclosure;

at least two substantially identical side walls attachable to the floor; and a doorway permitting wheelchair access from the underlying support surface through one of the at least two substantially identical sidewalls and into the portable restroom enclosure from the underlying support surface.

39. The portable restroom enclosure of claim 38 wherein the floor has a weight that is equal to about ⅓ of a total weight of the portable restroom enclosure.

40. The portable restroom enclosure of claim 38 wherein the floor has a weight that is greater than ⅓ of a total weight of the portable restroom enclosure.

41. The portable restroom enclosure of claim 38 wherein a total distance from the underlying supporting surface to the upper surface of the floor is equal to a thickness of the floor.

42. The portable restroom enclosure of claim 38 wherein the thickness of the floor is less than about 1".

43. The portable restroom enclosure of claim 38 wherein the toilet system includes a holding tank and a ventilation pipe.

44. The portable restroom enclosure of claim 38 wherein the floor has a weight effective to stabilize the restroom when exposed to a wind.

45. The portable restroom enclosure of claim 38 wherein the floor has a lower surface that has a low coefficient of friction.

46. The portable restroom enclosure of claim 38 wherein the upper surface of the floor is an anti-skid surface.

47. A portable restroom enclosure permitting wheelchair access comprising:

a floor sized to permit movement of a wheelchair, the floor having an upper surface and a lower surface wherein the upper surface of the floor is positionable within a predetermined distance of an underlying support surface, wherein the predetermined distance is within a range permitting rolling movement of a wheelchair from the underlying support surface to the upper surface;

a toilet system located on and positioned above the upper surface of the floor within the enclosure;

at least two substantially identical side walls attachable to the floor; and a doorway permitting wheelchair access from the underlying support surface through one of the at least two substantially identical sidewalls and into the portable restroom enclosure.

48. The portable restroom enclosure of claim 47 wherein the predetermined distance is less than or equal to about one inch.

49. The portable restroom enclosure of claim 47 wherein the floor has a weight that is equal to about ⅓ of a total weight of the portable restroom enclosure.

50. The portable restroom enclosure of claim 47 wherein the floor has a weight that is at least ⅓ of a total weight of the portable restroom enclosure.

51. The portable restroom enclosure of claim 47 wherein a total distance from the underlying supporting surface to the upper surface of the floor is equal to a thickness of the floor.

52. The portable restroom enclosure of claim 51 wherein the thickness of the floor is less than about 1".

53. The portable restroom enclosure of claim 47 wherein the toilet system includes a holding tank and a ventilation pipe.

54. The portable restroom enclosure of claim 47 wherein the floor has a weight effective to stabilize restroom when exposed to a wind.

55. The portable restroom enclosure of claim 47 wherein the lower surface has a low coefficient of friction.

56. The portable restroom enclosure of claim 47 wherein the upper surface of the floor is an anti-skid surface.

57. A portable restroom enclosure permitting wheelchair access comprising:

a floor sized to permit movement of a wheelchair, wherein the floor is positionable so as to be in contact with an underlying supporting surface;

a toilet system located on and positioned above an upper surface of the floor within the enclosure;

at least three side walls attachable to the floor; and a doorway permitting wheelchair access from the underlying support surface through one of the at least three substantially identical sidewalls and into the portable restroom enclosure from the underlying support surface.

58. The portable restroom enclosure of claim 57 wherein the floor has a weight that is equal to about ⅓ of a total weight of the portable restroom enclosure.

59. The portable restroom enclosure of claim 57 wherein the floor has a weight that is greater than ⅓ of a total weight of the portable restroom enclosure.

60. The portable restroom enclosure of claim 57 wherein a total distance from the underlying supporting surface to the upper surface of the floor is equal to a thickness of the floor.

61. The portable restroom enclosure of claim 60 wherein the thickness of the floor is less than about 1".

62. The portable restroom enclosure of claim 57 wherein the toilet system includes a holding tank and a ventilation pipe.

63. The portable restroom enclosure of claim 57 wherein the floor has a weight effective to stabilize the restroom when exposed to a wind.

64. The portable restroom enclosure of claim 57 wherein the floor has a lower surface that has a low coefficient of friction.

65. A portable restroom enclosure permitting wheelchair access comprising:

a floor sized to permit movement of a wheelchair, the floor having an upper surface and a lower surface wherein the upper surface of the floor is positionable within a predetermined distance of an underlying support surface, wherein the predetermined distance is within a range permitting rolling movement of a wheelchair from the underlying support surface to the upper surface;

a toilet system located on and positioned above the upper surface of the floor within the enclosure;

at least three side walls attachable to the floor; and a doorway permitting wheelchair access from the underlying support surface through one of the at least three sidewalls and into portable restroom enclosure.

66. The portable restroom enclosure of claim 65 wherein the predetermined distance is less than or equal to about one inch.

67. The portable restroom enclosure of claim 65 wherein the floor has a weight that is equal to about ⅓ of a total weight of the portable restroom enclosure.

68. The portable restroom enclosure of claim 65 wherein the floor has a weight that is at least ⅓ of a total weight of the portable restroom enclosure.

69. The portable restroom enclosure of claim 65 wherein a total distance from the underlying supporting surface to the upper surface of the floor is equal to a thickness of the floor.

70. The portable restroom enclosure of claim 69 wherein the thickness of the floor is less than abort 1".

71. The portable restroom enclosure of claim 65 wherein the toilet system includes a holding tank and a ventilation pipe.

72. The portable restroom enclosure of claim 65 wherein the floor has a weight effective to stabilize the restroom when exposed to a wind.

73. The portable restroom enclosure of claim 65 wherein the lower surface has a low coefficient of friction.

74. The portable restroom enclosure of claim 65 wherein the upper surface of the floor is an anti-skid surface.

75. The portable restroom enclosure of claim 65 further including a rail positioned on at least two of the at least three sidewalls thereby stiffening the enclosure.

* * * * *

UNITED STATES PATENT AND TRADEMARK OFFICE

CERTIFICATE OF CORRECTION

PATENT NO. : 6,115,971

DATED : September 12, 2000

INVENTOR(S) : Douglas E. Loebertmann and Michael Holm

It is certified that error appears in the above-indentified patent and that said Letters Patent is hereby corrected as shown below:

Column 10, line 20, delete the word "abort" and insert the word --about--

Signed and Sealed this

Eighth Day of May, 2001

*Attest:*

Nicholas P. Godici

NICHOLAS P. GODICI

*Attesting Officer*

*Acting Director of the United States Patent and Trademark Office*